US008292112B2

(12) United States Patent
Chang

(10) Patent No.: US 8,292,112 B2
(45) Date of Patent: Oct. 23, 2012

(54) ALUMINUM CONTAINER

(76) Inventor: Charles Chang, Wayne, NJ (US)

( * ) Notice: Subject to any disclaimer, the term of this patent is extended or adjusted under 35 U.S.C. 154(b) by 141 days.

(21) Appl. No.: 12/798,052

(22) Filed: Mar. 29, 2010

(65) Prior Publication Data

US 2010/0219188 A1 Sep. 2, 2010

Related U.S. Application Data

(60) Provisional application No. 61/211,468, filed on Mar. 30, 2009.

(30) Foreign Application Priority Data

Oct. 23, 2007 (WO) ..... PCT/US2007/022447

(51) Int. Cl.
*B65D 17/34* (2006.01)

(52) U.S. Cl. ..... 220/269; 206/222; 206/459.5; 220/258.4; 220/270; 220/821; 220/906

(58) Field of Classification Search ..... 220/258.4, 220/269, 270, 821, 906; 206/222, 459.5
See application file for complete search history.

(56) References Cited

U.S. PATENT DOCUMENTS 4,779,754 A * 10/1988 Ten Eyck et al. ..... 220/254.1
5,782,373 A * 7/1998 Bianchi ..... 220/269
2004/0108237 A1* 6/2004 McClintock ..... 206/459.1

FOREIGN PATENT DOCUMENTS

JP 200491022 * 3/2004

* cited by examiner

*Primary Examiner* — Anthony Stashick
*Assistant Examiner* — Elizabeth Volz
(74) *Attorney, Agent, or Firm* — K. Gibner Lehmann

(57) ABSTRACT

An aluminum container for dispensing beverage, includes a can having a cylindrical side wall, and transverse top and bottom walls. A pull tab mechanism is provided on the top wall to effect opening of the container. The transverse top wall has an upstanding peripheral rim, with one or two interrupted wall portions, one of said portions forming a spout for pouring the contents, or drinking from the container directly. The other of the interrupted wall portions provides a clearance space for facilitating the insertion of the user's finger beneath the pull tab in readiness for opening the container. The bottom wall of the container is provided with a removable appliqué, which may contain printed text/pictorial information, or information in the nature of a store or manufacturer's product coupon.

8 Claims, 6 Drawing Sheets

ALUMINUM CONTAINER

CROSS REFERENCES TO RELATED APPLICATIONS

1. The present application claims the priority of the subject matter and the filing date of my prior Provisional Application No. 60/854,294 filed Oct. 26, 2006.

2. The present application also claims the priority of the subject matter and the filing date of my prior U.S. application Ser. No. 11/713,860 filed Mar. 5, 2007.

3. The present application also claims the priority of the subject matter and the filing date of my prior PCT International Application No. PCT/US2007/22447 filed Oct. 23, 2007. **

** and priority of Prov. App. 61/211,468 filed Mar. 30, 2009.

TECHNICAL FIELD

This invention relates to thin-walled, aluminum containers of the type currently utilized to dispense a multitude of liquids, particularly a wide variety of beverages for human consumption, such as sodas and the like.

BACKGROUND ART

The cleanness of a two piece aluminum beverage can has always been a concern to the consumer. The prior art cans consist of a can body and a lid. The lid is crimped on the open end of the can body. The lid has an inside groove along the crimping rim to assist the crimping operation. Over the last 30 years, the inside groove has grown deeper when the lid became thinner, to save on metal. The deeper groove makes cleaning the dirt accumulated inside the groove more difficult. This is a big concern especially to mothers with young children.

As the industry tries to save aluminum metal by thinning the lid, it has also reduced the diameter of the lid. Consequently, it has made pulling the pull tab more difficult. Many consumers even break their nails when trying to pull the pull tab.

DISCLOSURE OF THE INVENTION

The invention is believed to attain at least some of the following objects:

To provide an improved aluminum container which retains the upstanding rim that has come to characterize the typical existing units on store shelves, while providing a convenient pouring notch in the rim, to facilitate transfer of the container contents to either a glass, or cup, or to facilitate drinking from the container without the likelihood of spilling.

To provide an improved aluminum container which retains the upstanding rim that has come to characterize the typical existing units on store shelves, while providing a convenient finger notch in the rim, to facilitate placement of the user's forefinger underneath the pull tab, and with his fingernail, lift the tab in readiness for opening the container. The likelihood of breaking one's fingernail is thereby reduced, as is the possibility of cutting one's finger during opening the container.

To provide an improved aluminum container which accommodates an appliqué in a heretofore unused area of the container, specifically the bottom transverse wall thereof. The appliqué may contain both textual and pictorial information, such as a store coupon for redemption, or an advertisement.

Preferably the appliqué is applied with releasable adhesive so that it may be readily peeled off by the ultimate consumer.

BEST MODE FOR CARRYING OUT THE INVENTION

Figure 2:
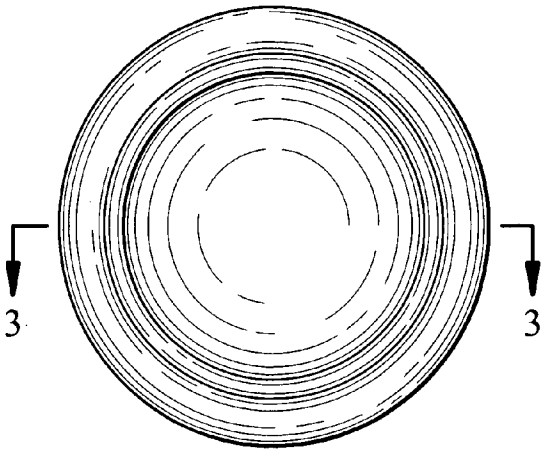
FIG. 2 (Prior Art)
FIG. 2 is a bottom plan view of the container of FIG. 1, taken on the line 2-2 of FIG. 1.
Figure 3:
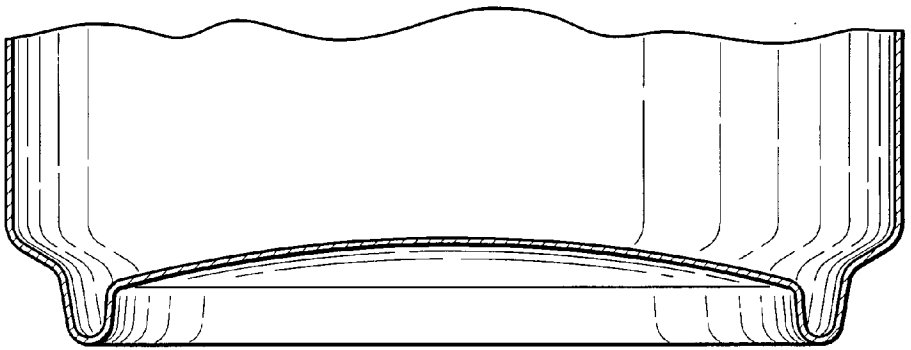
FIG. 3 (Prior Art)
FIG. 3 is a fragmentary vertical section of the container of FIGS. 1 and 2, showing the details of the bottom wall and formed rim thereof.
Figure 1:
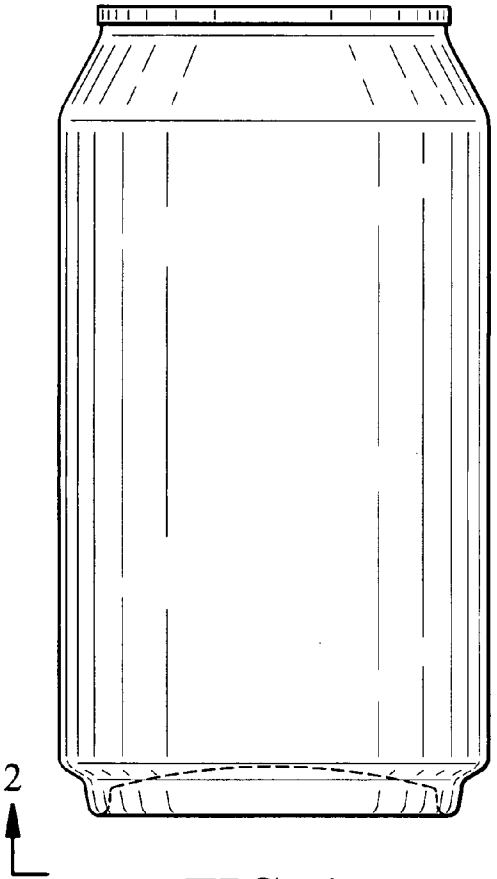
FIG. 1 (Prior Art)
FIG. 1 is a front elevation of a beverage container that is typical of what is available to the consumer now.
Figure 5:
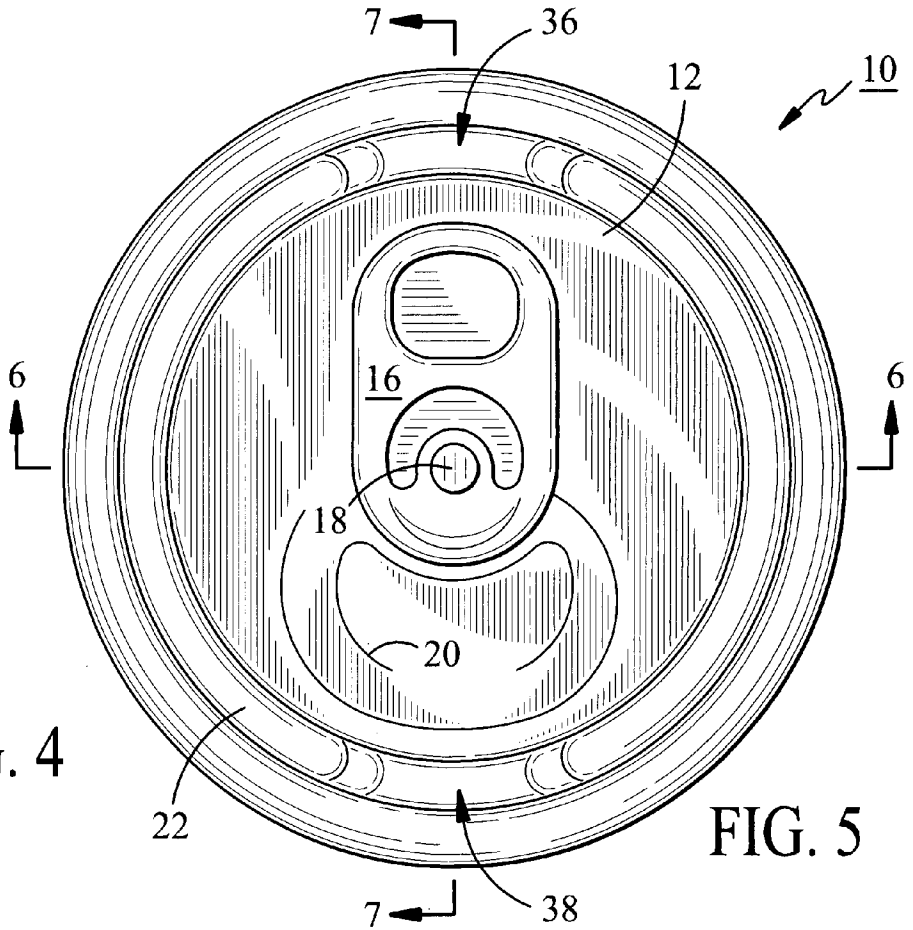
FIG. 5 is a bottom plan view of the container of FIG. 4, taken on the line 5-5 of FIG. 4.

FIGS. 1-3 illustrate a prior art container construction. In FIG. 1, the upper portion of the container has a crimp to a transverse top wall, the latter having a deep groove (not shown) between the crimp and a central plateau of the transverse top wall. The plateau structure carries a pull tab, in a known manner per se.

One of the disadvantages of this construction lies in the fact that dirt can become lodged in the groove during shipping and storage, and thus the drinking surface of the can may readily become contaminated during the time of assembly of the container and the time that the consumer initially opens it.

This has remained a problem in spite of the wide popularity of aluminum cans for soda, beer and other beverages.

DETAILED DESCRIPTION

Figure 4:
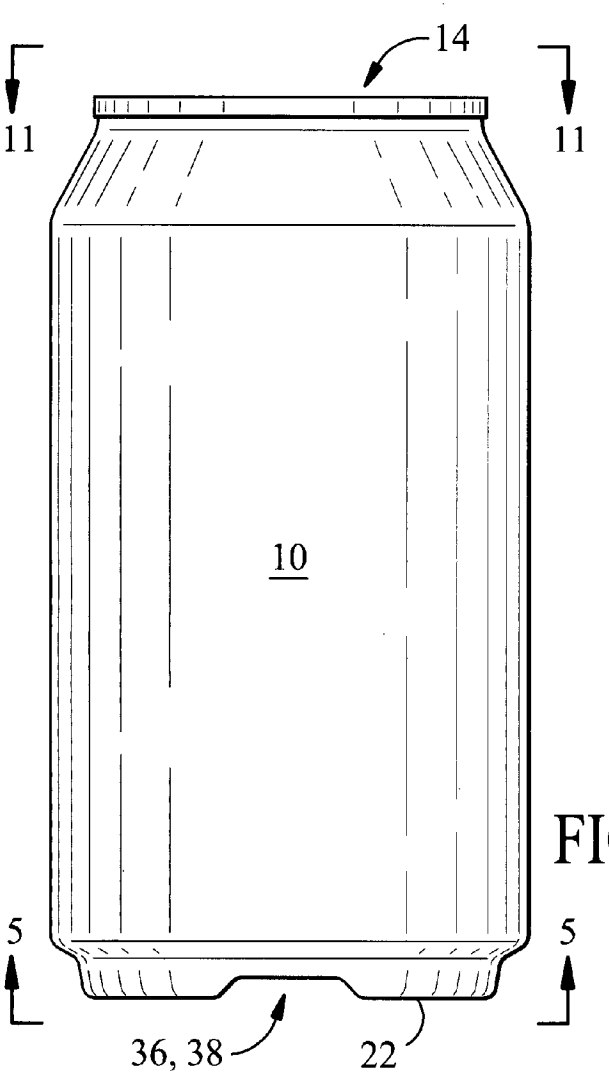
FIG. 4 is a front elevation of the improved container of the invention, shown inverted.
Figure 6:
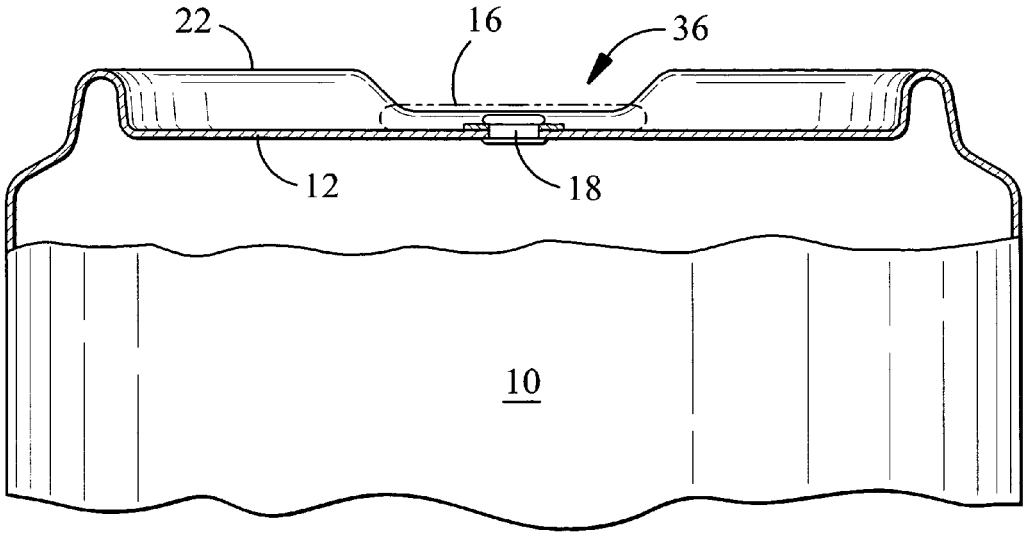
FIG. 6 is a front view, partly in elevation and partly in vertical section, of the improved container of the invention, showing the transverse top wall thereof, and a peripheral rim thereon, the rim having one or two interrupted wall portions provided for carrying out the invention. The view is taken on line 6-6 of FIG. 5.
Figure 7:
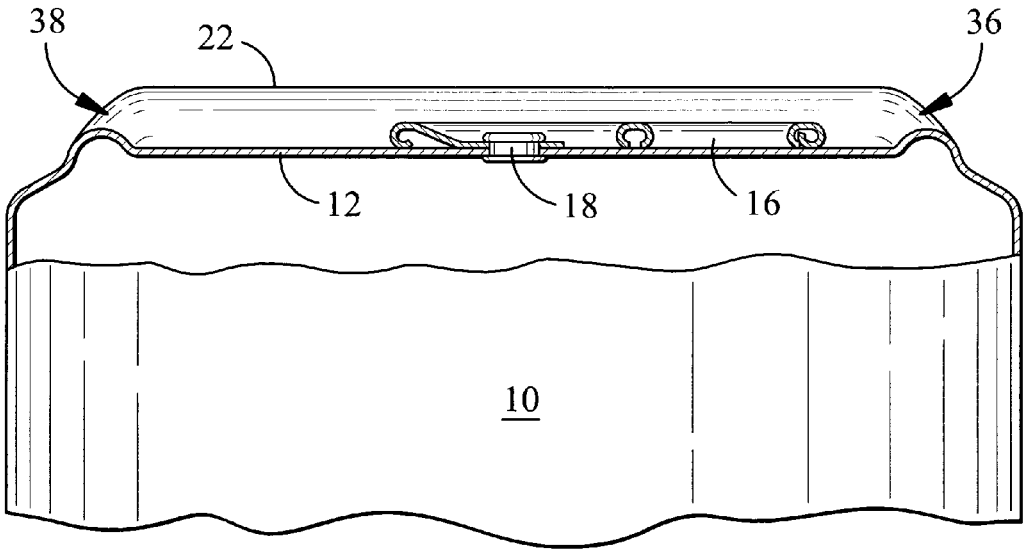
FIG. 7 is a view like FIG. 6, partly in elevation and partly in vertical section, of the improved container of the invention, showing the transverse top wall thereof, and the peripheral rim thereon, and showing the far half of each of two interrupted wall portions, this view being taken on the line 7-7 of FIG. 5.
Figure 8:
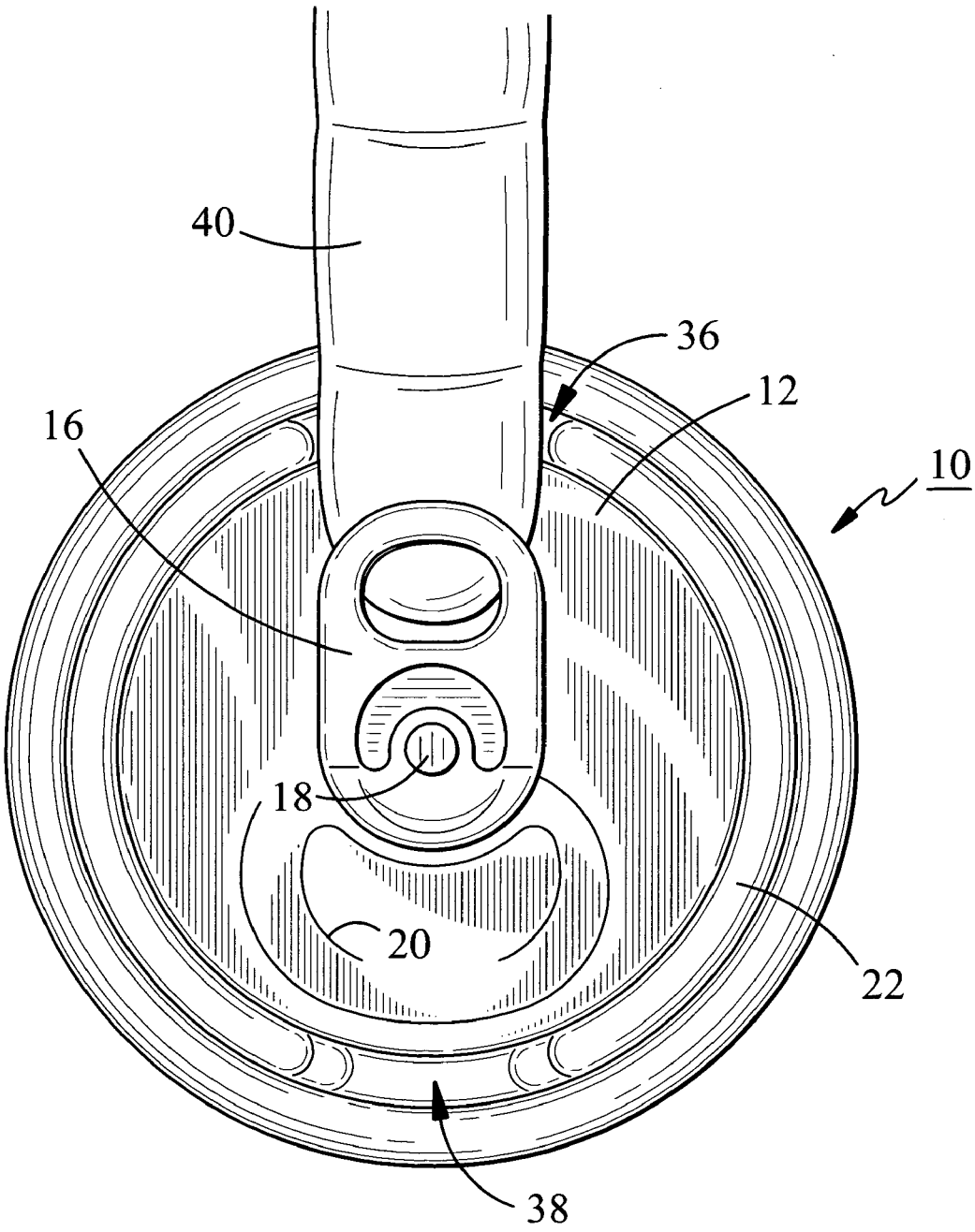
FIG. 8 is a top plan view of the container of the invention, showing the clearance provided by one interrupted wall portion in the upstanding rim of the transverse top wall, and illustrating a user's finger inserted therein and about to engage the edge of the pull top with his finger and pry the pull top upwardly.

The improved aluminum container of the invention is illustrated in FIGS. 4-7 and 11-12. FIG. 4 shows a front elevation of the container, the latter having a substantially cylindrical side wall 10 and transverse top wall 12, and transverse bottom wall 14. The side wall 10 and top wall 12 are integral with one another, being formed in a drawing operation, and the transverse bottom wall 14 crimped to the side wall 10 by means of a conventional crimp. FIGS. 6 and 7 clearly show the single layer nature of side wall 10 and top wall 12, resulting from said drawing operation. A pull tab 16 is secured to the integrally formed top wall 12 by a rivet post 18 which establishes an air tight and liquid tight connection between the pull tab 16 and integral transverse top wall 12. A scored area 20 of weakness is impressed on the transverse top wall 12, in a location where it is to be puncturable and form an opening when the pull tab is lifted, as will be noted further below.

In accordance with the present invention, the transverse top wall 12 has a upwardly extending peripheral rim 22, which has portions substantially surrounding a large part of the top wall 12, except for two oppositely disposed depressed rim wall portions designated 36 and 38. It is noted that one of the depressed rim wall portions 36 is substantially aligned with the finger-engageable portion of the pull tab 16. By the invention the depressed rim wall portion 36 provides a clearance area which is adapted to accommodate the forefinger 40 of the user, and facilitate his engagement with the finger-engageable portion of the pull tab 16 by his fingernail. The advantage of this construction is to facilitate access to the pull tab 16, which would otherwise be disposed below the peripheral rim 22 in the absence of such a depressed wall portion.

Figure 9:
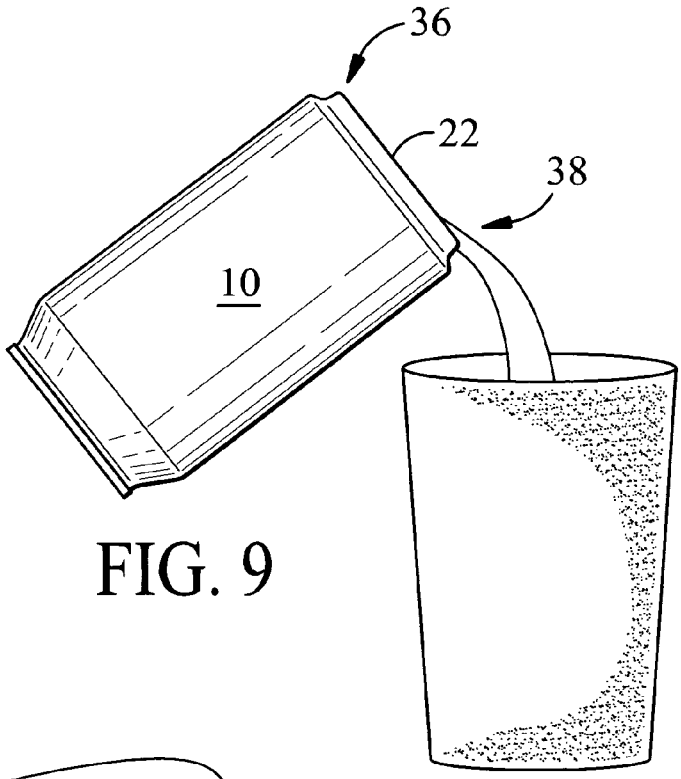
FIG. 9 is a side elevation of a can of the invention, showing it pouring its contents into a drinking glass, and illustrating the action of that interrupted wall portion of the upstanding rim in facilitating a smooth stream from the container to the glass.
Figure 10:
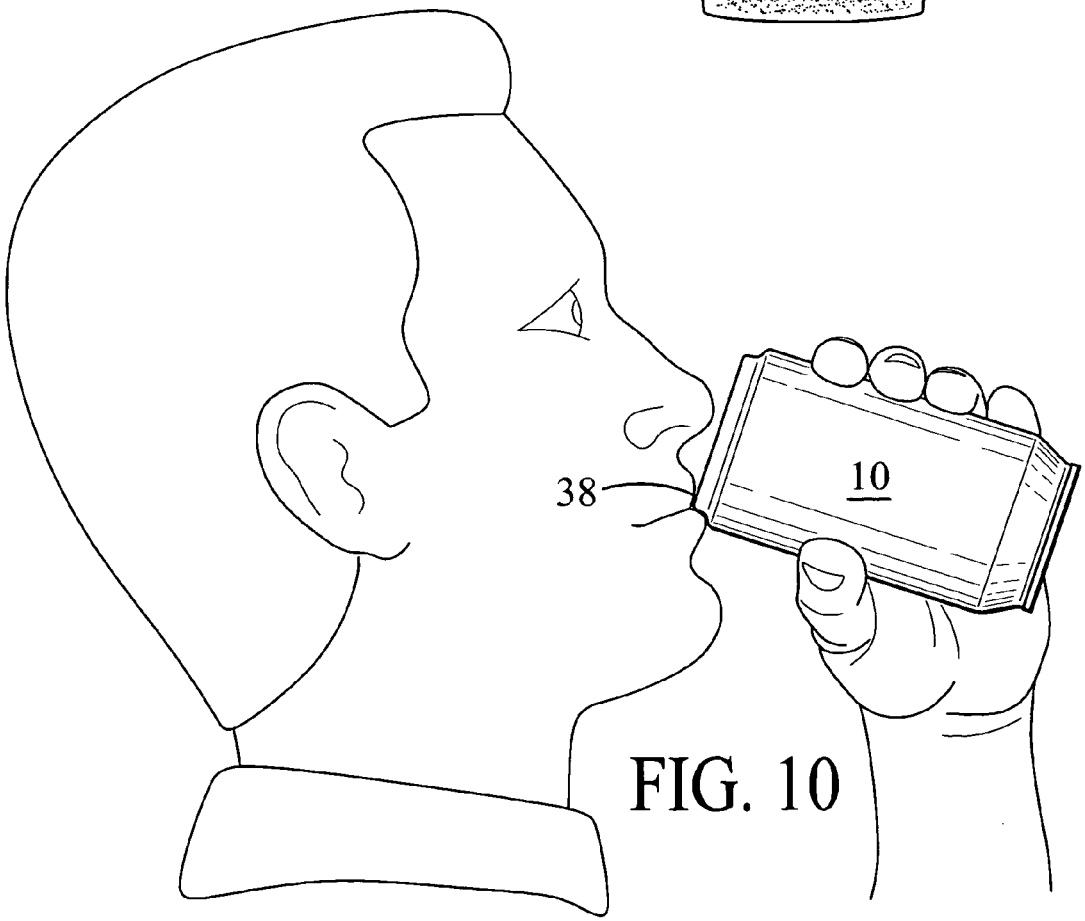
FIG. 10 is a fanciful view of a person drinking from the container of the invention, utilizing the interrupted wall portion of the upstanding rim so as to avoid or minimize the possibility of spillage.

Further by the invention, there is provided in a circumferentially spaced location of the upstanding peripheral rim 22, the second depressed rim portion 38. This functions as a pouring spout as shown in FIG. 9, and assists in establishing a smooth flow of liquid from the opening in the top of the container to a cup or glass. In the alternative, it provides an uninterrupted path for the liquid to flow from the container to the user's mouth, as in FIG. 10.

Figure 11:
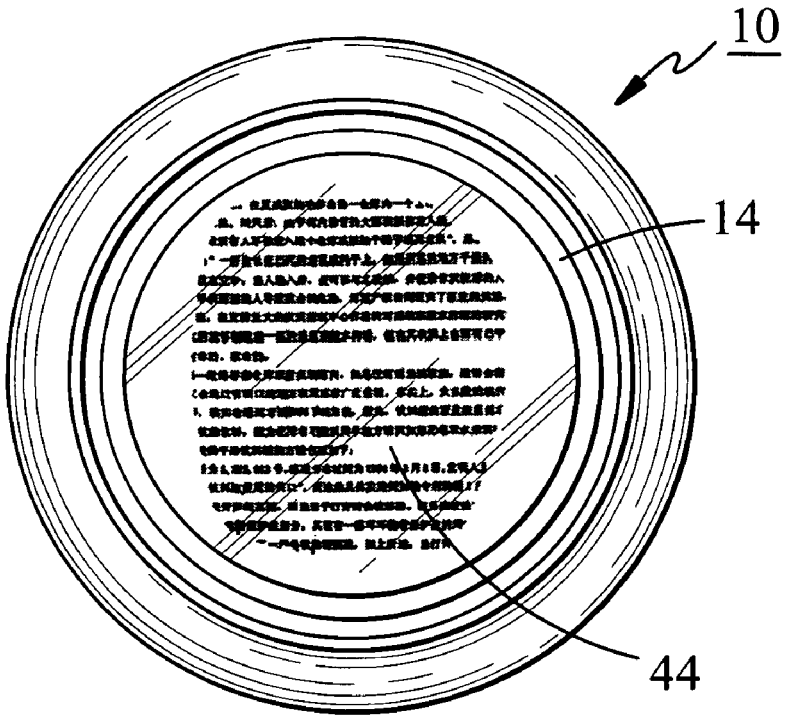
FIG. 11 is a bottom plan view of the container of the invention, showing an appliqué releasably affixed to the transverse bottom wall thereof, as by adhesive (not shown), the appliqué having text or pictorial information thereon, as for example a store sale coupon or other advertisement.
Figure 12:
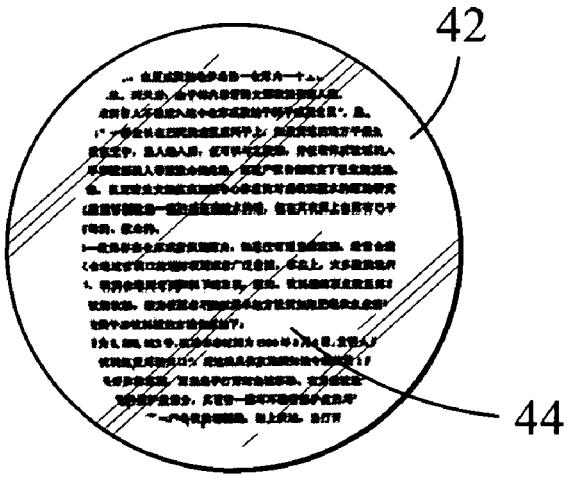
FIG. 12 is a plan view of the appliqué per se, having been peeled off the bottom transverse wall of the container of FIG. 11.

Further, referring to FIGS. 11 and 12 and in accordance with the invention, the bottom transverse wall 14 of the container is provided with an appliqué 42, which may preferably take the form of an adhesive backed, stick-on label. The label can be constituted of paper, plastic, rubber or other synthetic. It is preferably decorated with printed material 44 which can be pictorial in nature and/or text material, such as a store coupon, or an advertisement. FIG. 12 shows a plan view of the appliqué after it has been removed.

The construction thus disclosed is seen to represent a distinct advance and improvement in the technology of aluminum container manufacture.

Variations and modifications are possible.

| List of reference numerals: | |
|---|---|
| 10 | Side wall |
| 12 | Transverse top wall |
| 14 | Transverse bottom wall |
| 16 | Pull tab |
| 18 | Rivet post |
| 20 | Scored area |
| 22 | Upstanding peripheral rim |

-continued

| List of reference numerals: | |
|---|---|
| 36 | Depressed wall portion in rim |
| 38 | Depressed wall portion in rim |
| 40 | Forefinger of user |
| 42 | Applique |
| 44 | Printed material |

The invention claimed is:

1. An aluminum container for soda and the like, comprising in combination:

a) a cup-like body having a cylindrical side wall, a transverse top wall, and a crimped lid forming a transverse bottom wall, said transverse top wall and said cylindrical side wall being formed as a single extruded piece of metal, b) said extruded piece of metal further having an upstanding peripheral rim between said cylindrical side wall and said transverse top wall, said rim having a pair of raised portions extending above said transverse top wall, c) the top wall of said extruded piece of metal having a pull tab, a rivet post to join the pull tab to the top wall, and a thin-walled area with scored line of weakness adapted to be punctured by the pull tab when the latter is lifted by the fingers of the user, ultimately providing an opening in the top wall of said single extruded piece of metal, d) all portions of said pull tab being positioned below the upstanding peripheral rim, so as to not interfere with stacking or handling of the containers when the latter are stored or processed, respectively.

2. An aluminum container as set forth in claim 1, wherein:

a) said upstanding peripheral rim has an interrupted wall portion that has a depth immediately communicating with said transverse top wall, said interrupted wall portion providing a pouring spout from the opening in the transverse top wall, and outwardly past the remainder of said interrupted wall portion.

3. An aluminum container as set forth in claim 1, wherein:

a) said upstanding peripheral rim has an interrupted wall portion immediately communicating with said transverse top wall, and whose depth substantially intersects and constitutes a continuation of the remainder of said transverse top wall to thereby enable a user to more easily insert his forefinger through said interrupted wall portion and thereafter slide his fingernail underneath part of said pull tab in readiness for raising said part and opening the container.

4. An aluminum container as set forth in claim 1, wherein:

a) said upstanding peripheral rim has an interrupted wall portion which has a depth immediately communicating with said transverse top wall, said interrupted wall portion providing a pouring spout from the opening in the transverse top wall, and outwardly past the remainder of said interrupted wall portion, b) said upstanding peripheral rim further has a second interrupted wall portion immediately communicating with said transverse top wall, and whose depth substantially constitutes a continuation of the remainder of said transverse top wall to thereby enable a user to more easily insert his forefinger through said second interrupted wall portion and thereafter slide his fingernail underneath part of said pull tab in readiness for raising said part and opening the container.

5. An aluminum container as set forth in claim 1, and further including:

a) an appliqué carried on the crimped lid that forms the transverse bottom wall, said appliqué containing printed and/or pictorial information, b) said appliqué being secured by releasable adhesive to enable the appliqué to be peeled off by the user.

6. The invention as set forth in claim 5, wherein said appliqué comprises advertising material or a manufacturer's coupon on its face.

7. The invention as set forth in claim 5, wherein said appliqué is constituted of paper, resilient plastic or rubber substance.

8. The invention as set forth in claim 3, wherein the pull tab of the container is elongated, and said interrupted wall portion of the upstanding rim is substantially aligned with the elongated pull tab of the container.

* * * * *